United States Patent [19]

Pomeschikov et al.

[11] 4,049,901

[45] Sept. 20, 1977

[54] ELECTROSLAG FURNACE

[76] Inventors: Andrei Grigorievich Pomeschikov, ulitsa Rimskogo-Korsa-kova, 10, kv. 2; Firs Alexandrovich Buryagin, ulitsa Nemirovicha-Danchenko, 18/1, kv. 39; Lev Seliverstovich Kazantsev, ulitsa Rimskogo-Korsa-kova, 11, kv. 69; Gennady Fedorovich Skvortsov, prospekt Karla Marxa, 25, kv. 26; Jury Anatolievich Naryshkin, ulitsa Bljukhera, 7, kv. 55, all of, Novosibirsk; Zinaida Ivanovna Gracheva, oblasti, ulitsa Oktyabrskaya, 8, kv. 12, Voskresensk Moskovskoi, all of U.S.S.R.

[21] Appl. No.: 660,666

[22] Filed: Feb. 23, 1976

[51] Int. Cl.[2] ..... H05B 3/60

[52] U.S. Cl. ..... 13/9 ES

[58] Field of Search ..... 13/9, 9 ES, 14–17, 13/13

[56] References Cited

U.S. PATENT DOCUMENTS

| | | | |
|---|---|---|---|
| 3,614,285 | 10/1971 | Holzgruber et al. | 13/14 |
| 3,660,584 | 5/1972 | Holzgruber et al. | 13/14 |
| 3,944,714 | 3/1976 | Shtanko et al. | 13/9 ES |

*Primary Examiner*—R. N. Envall, Jr.

*Attorney, Agent, or Firm*—Lackenbach, Lilling & Siegel

[57] ABSTRACT

The invention contemplates an electroslag furnace, wherein a vertical column is provided with an even number of supports, the carriages of the electrode holder and mould moving along guides on the supports, and in spaces between the supports there are provided hoses of a cooling system connected to the mould and to a bottom mounting for the mold, current supply cables being also connected to the bottom.

5 Claims, 5 Drawing Figures

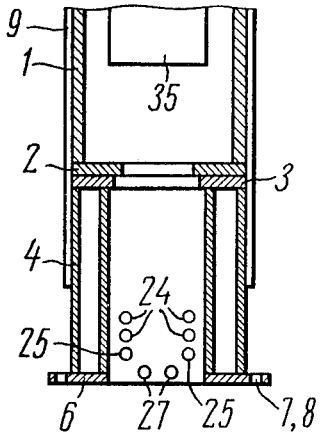
FIG. 2
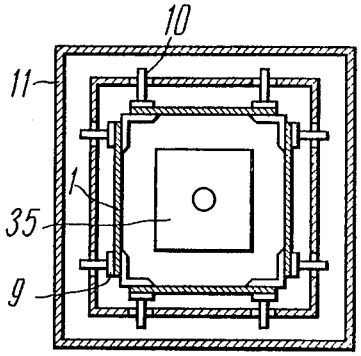
FIG. 5
FIG. 3
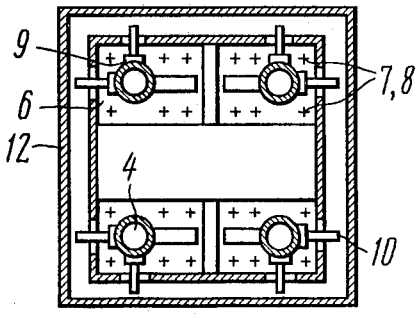
FIG. 4
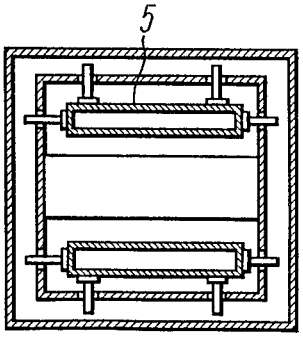

ELECTROSLAG FURNACE

The present invention relates to equipment to be used in the electric metallurgy, and more particularly, to electroslag furnaces.

The invention may be used for remelting consumable electrodes under a layer of liquid slag and for producing high-grade metal ingots and alloys in ferrous and non-ferrous metallurgy.

Widely known in the art are electroslag furnaces comprising a column in the form of an all-welded vertical box-shaped rectangular structure having internal ridges and a shaft for accommodating a balance weight of an electrode holder carriage.

The column is externally provided with vertically extending guides for displacement of roller mounted carriages of the electrode holder and mould. The mould is arranged under the electrode holder and is mounted on a bottom plate or the like which is secured to a self-propelled car. Hoses of a cooling system are connected to the mould and bottom plate, the hoses extending on either side of the furnace column. In addition, current supply cables are also connected to the bottom, the cables also extending around the external walls of the column.

Disadvantages of such electroslag furnaces are, first of all, associated with an excessive length of the current supply cables connected to the bottom so that their active and inductive resistance is rather high, and technical and economical performance is impaired, and primarily the electric losses are increased for that reason. The current supply cables extending around the column induce currents therein resulting in heating of the column.

The length of the cooling system hoses connected to the mould and bottom plate is also increased. The arrangement of the current supply cables and cooling system hoses hampers the access to the electroslag furnace thus making the operation difficult.

Known in the art are also electroslag furnaces having a column consisting of two all-welded box-shaped supports with an open space therebetween extending from the top to bottom. The supports are mounted on a foundation and interconnected at the top portions by means of a common frame. Balance weights are accommodated inside the supports. Carriages of the electrode holder and mould move along the support guides.

The mould mounted on a bottom is secured to a carriage.

Current supply cables to the bottom plate extend in the space between the supports. The length of the cables is shorter than of those in the electroslag furnace having the column comprising a single solid box-shaped structure. The access to the furnace is better, and the electric losses are lower.

The electroslag furnaces of such a construction have, however, specific disadvantages inherent therein.

The provision of two independent supports makes the furnace non-compact, increases the size and weight thereof.

There are technological difficulties and inconvenience in the manufacture, transportation and assembly of independent supports whose guides are to be manufactured and assembled with the accuracy ensuring normal displacement of the electrode holder and mould carriages along the entire height of the column.

It is an object of the invention to eliminate the above disadvantages.

Another object of the invention is to provide an electroslag furnace which is more compact, lighter in weight and more economic in operation (with better technical and economical performance characteristics).

The above objects are accomplished by an electroslag furnace having a vertical column mounting electrode holder carriages and mould carriages movable along guides, hoses of a cooling system being connected to the mould and to a bottom mounting the mould, and current supply cables being also connected to the bottom, wherein, according to the invention, the vertical column is provided with an even number of supports, the current supply cables and hoses of the cooling system extending in spaces between the supports, the guides for the carriages being arranged on the vertical column and on the supports.

The electroslag furnace according to the invention is more compact, has smaller weight and size, is convenient for manufacture and assembly and is more economical.

The provision of an even number of supports on the column provides for the formation of a space under the column for arranging therein current supply cables and cooling system hoses connected to the bottom and mould. The even number of supports permits the cooling system and current supply means to be accommodated in a manner which is the most convenient for operation and maintenance since the current supply cables and hoses of the cooling system can be now arranged along the longitudinal axis of the furnace (or column) and their length is minimized.

The column is preferably provided with four supports because with this arrangement, an access to under the column and to the adjacent assemblies of the furnace is enabled on either side.

The shortest possible length of the current supply cables results in a reduction of losses in the low-voltage circuit, this improving the power coefficient and other performance characteristics of the furnace (such as the efficiency of the electroslag furnace, specific power consumption).

The invention will now be described with reference to a specific embodiment thereof illustrated in the accompanying drawings, in which:

FIG. 1 diagrammatically shows a side-elevational view, partly in cross-section, of the electroslag furnace according to the invention, wherein the column is provided with an even number of supports and current supply cables and cooling system hoses extend in the space therebetween.

FIG. 2 is a sectional view taken along the line II—II in FIG. 1;

FIG. 3 is a sectional view taken along the line III—III in FIG. 1;

FIG. 4 is a view similar to FIG. 3, but showing an embodiment of the electroslag furnace with two supports;

FIG. 5 is a sectional view taken along the line V—V in FIG. 1.

Figure 1:
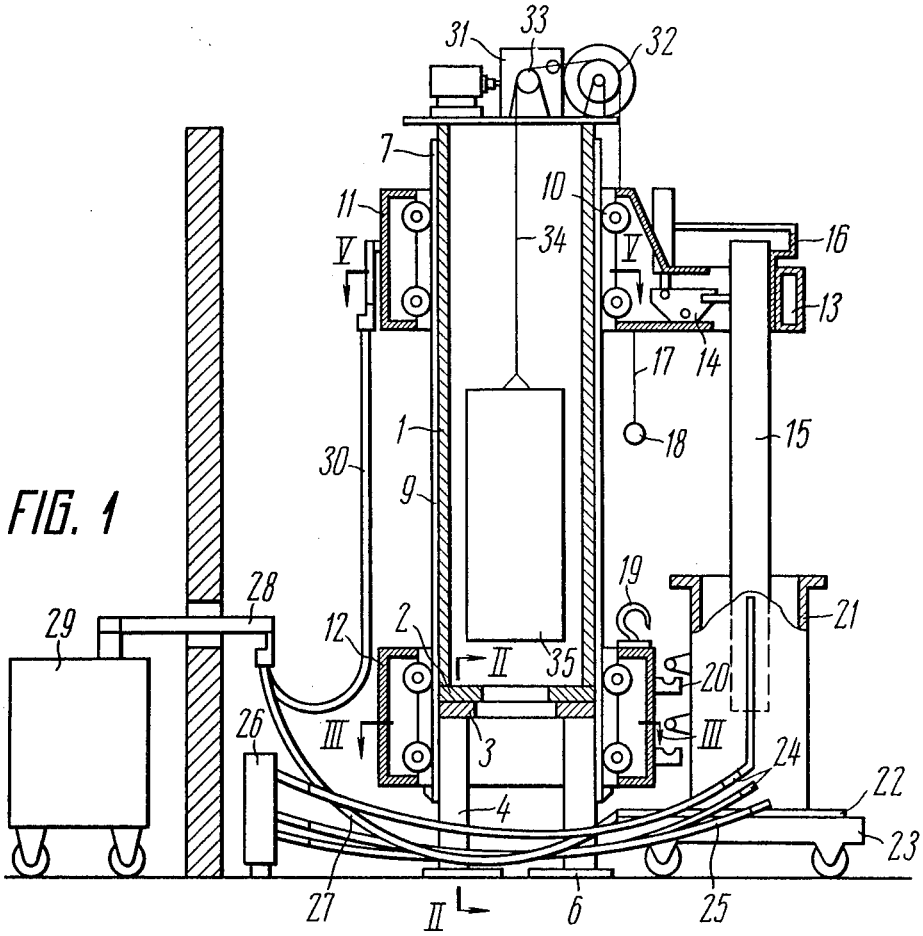

The electroslag furnace according to the invention (FIGS. 1,2) comprises a column 1 which is made in the form of a all-welded rectangular section box-shaped structure with or without internal ridges. At the bottom portion, the end of the column 1 terminates in a bottom flange 2.

A flange 3 (similar to the bottom flange 2) is bolted or welded to the bottom flange 2 of the column 1, and four supports 4 (FIG. 3), e.g., of tubular shape are rigidly secured to the flange 3. Depending on the size and weight of the electroslag furnace, the flange 3 (FIGS. 1,2) may be provided with two supports 5 (FIG. 4) or with a different even number of supports.

Each support 4 (FIGS. 1, 2 and 3) has a base 6 comprising a flange or a welded frame and having holes 7 for fastening to a foundatin.

The supports 4 are secured to the foundation of the electroslag furnace by means of bolts 8 passed through the holes 7.

Common vertical guides 9 are secured to the vertical column 1 (FIG. 1) and to the supports 4 which constitute the lower prolongation of the column 1, and a carriage 11 of an electrode holder and a carriage 12 of a mould are mounted to move along these guides on rollers 10.

An electrode holder 13 is mounted on the carriage 11 and is provided with a clamping mechanism 14 for clamping and holding consumable electrodes 15, and with a current lead 16 for applying a voltage thereto.

The carriage 11 of the electrode holder is provided with chains 17 having rings 18 for coupling to the mould carriage 12, the chains being arranged below the carriage adjacently to the electrode holder 13.

Accordingly, below the chain 17, the mould carriage 12 is provided with hooks 19 for engaging the rings 18 of the chains 17 for coupling the carriges 11 and 12.

The vertical wall of the mould carriage 12 is provided with grips 20 for coupling to a mould 21 which is arranged under the electrode holder 13 on a bottom 22.

The bottom 22 is mounted on a self-propelled car 23. Hoses 24 and 25 of a cooling system are connected to the mould 21 and to the bottom 22, respectively, the hoses being connected, at the other ends thereof, to a live and discharge lines, via a manifold 26. It should be noted, that in order to shorten the length of the hoses 24 and 25 of the cooling system and for providing convenient operation and maintenance of the furnace and compact construction thereof, the hoses extend in the space between the supports 4. In addition, current supply cables 27 of a low-voltage circuit 28 connected to a power supply source of the electroslag furnace, e.g., via a transformer 29 are connected to the bottom 22. The current supply cables 27 connected to the bottom 22 also extend in the space between the supports 4 thus passing closer to the axis of the column 1 so as to minimize their length and to enlarge the spacing from the inner walls of the supports 4 thus eliminating or reducing the induction of current in the supports and lowering power losses.

Current supply cables 30 are provided for feeding current from the low-voltage circuit 28 to the current supply device 16 of the electrode holder 13.

The displacement of the carriage 11 of the electrode holder and carriage 12 of the mould is effected by means of a drive 31 mounted on the top end of the column 1.

The drive 31 has drive sprokets 32 and support rollers 33. The electrode holder carriage 11 is connected to a balance weight 35 (FIGS. 1,5) accommodated inside the column 1 by means of chains 34 running around the sprokets 32 and the support rollers 33 for balancing the movable masses and for facilitating the operation of the drive 31 (FIG. 1).

The electroslag furnace according to the invention which is adjusted for operation, e.g., in accordance with the "electrode-bottom" pattern, functions in the following manner.

The electrode holder carriage 11 (FIG. 1) is mounted in the upmost position, and the mould carriage 12 is mounted in the lowermost position. The mould 21, which is preliminarily mounted on the bottom 22, is wheeled up on the car 23 to under the electrode holder 13.

The consumable electrode 15 is inserted into the electrode holder 13 by means of the clamping mechanism 14 and clamped therein. The mould 21 is aligned with the consumable electrode 15.

Then the carriage 11 is lowered by means of the drive 31 until the consumable electrode 15 is immersed at a preset depth in the layer of molten slag poured in the mould 21 by any appropriate method.

The transformer 29 is energized, and a voltage is applied, via the low-voltage circuit 28, current supply cables 27 and 30 and the current lead 16, to the bottom 22 and to the consumable electrode 15. The electric circuit between the consumable electrode 15 and the bottom 22 is thus made through the molten slag, and the remelting of the consumable electrode 15 begins.

After building-up of an ingot by moving the electrode holder carriage 11 upwards, the residue of the consumable electrode 15 is withdrawn from the mould 21 and removed.

After the ingot is cooled, the mould 21 is removed from the ingot by means of the mould carriage 12. For that purpose, the electrode holder carriage 11 is lowered to the lowermost position, the rings 18 of the chains 17 are engaged with the hooks 19 of the mould carriage 12. Then the electrode holder carriage 11 is again moved upwards. The chains 17 are tightened, and the mould carriage 12 starts rising. The mould carriage 12 engages the mould 21 with the grips 20 to move it upwards until the ingot is released. It should be noted that the cooling system hoses 24 connected to the mould 21 and extending in the space between the supports 4 also move together with the mould 21.

The released ingot standing on the bottom 22 is wheeled out from under the electrode holder 13 by means of the car 23. After the removal of the ingot from the bottom 22 and cleaning of the mould 21, the car 23 is again moved to under the electrode holder 13. The mould carriage 12 with the mould 21 suspended therefrom is moved into the lowermost position, the mould 21 being lowered and mounted on the bottom 22, and the rings 18 are then disengaged from the hooks 19, that is the mould carriage 12 is uncoupled from the electrode holder carriage 11. Then the electrode holder carriage 11 is moved into the upmost position. Thereafter the abovedescribed cycle of operation of the electroslag furnace is repeated.

The space formed by the supports 4 in the bottom portion of the column 1 provides for free arrangement of the hoses 24 and 25 of the cooling system and of the current supply cables 27 at the bottom 22 at any position of the carriages 11 and 12, bottom 22 with the car 23 and mould 21.

With a large height and weight of the column 1, the bottom portion thereof, that is the flange 3 with the supports 4 is preferably made detachable from the upper portion of the column to facilitate the manufacture, transportation and assembly.

Therefore, the above-described electroslag furnace having a column provided with an even number of supports, with the current supply cables and cooling system hoses extending in the space between the supports, is more compact, convenient and economical in operation. The shortest length of the current supply cables and their reasonable arrangement enable the lowering of electric losses, reduction of power consumption and improvement of the furnace efficiency.

The construction of the column and the respective arrangement of the current supply and cooling system means according to the invention may be used not only in electroslag furnaces of a similar design, but also in other installations and electroslag plants intended for a similar purpose having a construction different from that described above.

What is claimed is:

1. An electroslag furnace comprising: at least one pair of supports mounted on a foundation to provide a plurality of supports; a vertical column mounted on said supports substantially coaxially therewith, at least one pair of supports being spaced from each other on opposite sides of said vertical column to form a space under the same; guides secured to said supports and to said vertical column; a mould mounted on a bottom plate adjacent to said supports; an electrode holder mounted over said mould; an electrode holder carriage movable along said guides for displacing an electrode relative to said mould; a mould carriage movable along said guides along said supports; hoses of a cooling system extending in said space between said at least one pair of supports and below said column and connected to said mould and to said bottom plate; a plurality of current supply cables a number of which extend in said space between said at least one pair of supports and below said column and connected to the bottom plate and the balance of which are connected to said electrode holder carriage.

2. An electroslag furnace as defined in claim 1, wherein four supports are provided arranged to define a square with each of said supports being positioned in one of the corners of the square.

3. An electroslag furnace as defined in claim 1, wherein two supports are provided, each of said supports being generally elongate and together defining a square with each of said supports being positioned along opposite parallel sides of the square.

4. An electroslag furnace as defined in claim 1, wherein the height of said posts, and of said space, is of the same order of magnitude as the spacing between said supports.

5. An electroslag furnace as defined in claim 1, wherein the height of said posts, and of said space, is greater than the spacing between said supports.

* * * * *